US006802465B1

(12) United States Patent
Norcott et al.

(10) Patent No.: US 6,802,465 B1
(45) Date of Patent: Oct. 12, 2004

(54) SHREDDING MACHINE, AND METHOD OF PROVIDING A TIME DELAY IN A SHREDDING MACHINE

(75) Inventors: Stuart Leslie Norcott, Stourport on Severn (GB); Paul Arthur Aries, Brierley Hill (GB)

(73) Assignee: Acco-Rextel Group Services Limited, Buckingham (GB)

( * ) Notice: Subject to any disclaimer, the term of this patent is extended or adjusted under 35 U.S.C. 154(b) by 0 days.

(21) Appl. No.: 10/049,140

(22) PCT Filed: Apr. 17, 2000

(86) PCT No.: PCT/GB00/01463

§ 371 (c)(1),
(2), (4) Date: Jun. 10, 2002

(87) PCT Pub. No.: WO01/12331

PCT Pub. Date: Feb. 22, 2001

(30) Foreign Application Priority Data

Aug. 18, 1999 (GB) ..... 9919439

(51) Int. Cl.[7] ..... B02C 25/00

(52) U.S. Cl. ..... 241/36; 241/100; 241/236

(58) Field of Search ..... 241/100, 36, 236

(56) References Cited

U.S. PATENT DOCUMENTS 5,167,374 A 12/1992 Strohmeyer
6,250,574 B1 * 6/2001 Wu Huang ..... 241/36

FOREIGN PATENT DOCUMENTS

EP 0 792 691 A1 9/1997

* cited by examiner

*Primary Examiner*—Mark Rosenbaum
(74) *Attorney, Agent, or Firm*—Kirschstein, et al.

(57) ABSTRACT

A shredding machine comprises a housing, a shredding mechanism, a motor for operation of the shredding mechanism, a slot through which documentary material is fed for shredding by the mechanism, and an operating member movable from an operative position in which it extends across the slot, to an inoperative position retracted from the slot, in consequence of the feeding of the material into the slot, and returning, in the absence of the material in the slot, to its operative position under the action of a spring. A motor controller includes a microswitch having a plunger which is spring-urged into a projecting position, in which it is open circuit. The spring urges the operating member into its operative position. Thus, when material enters the slot, moving the operating member to its inoperative position, the plunger is depressed to start or permit operation of the shredding mechanism. A damper is interposed between the operating member and the resilient device, and includes a shallow cylindrical chamber within which a cylindrical drive member is mounted for rotary movement, such a movement being retarded by viscous material within the chamber. The drive member is connected to a drive arm, one end of which engages the operating member, the other end of which engages the plunger of the microswitch. Thus, on completion of passage of the material through the slot, releasing the operating member for movement to its operative position, the movement of the operating member to its operative position is retarded, allowing completion of passage of the sheet.

9 Claims, 3 Drawing Sheets

FIG 2
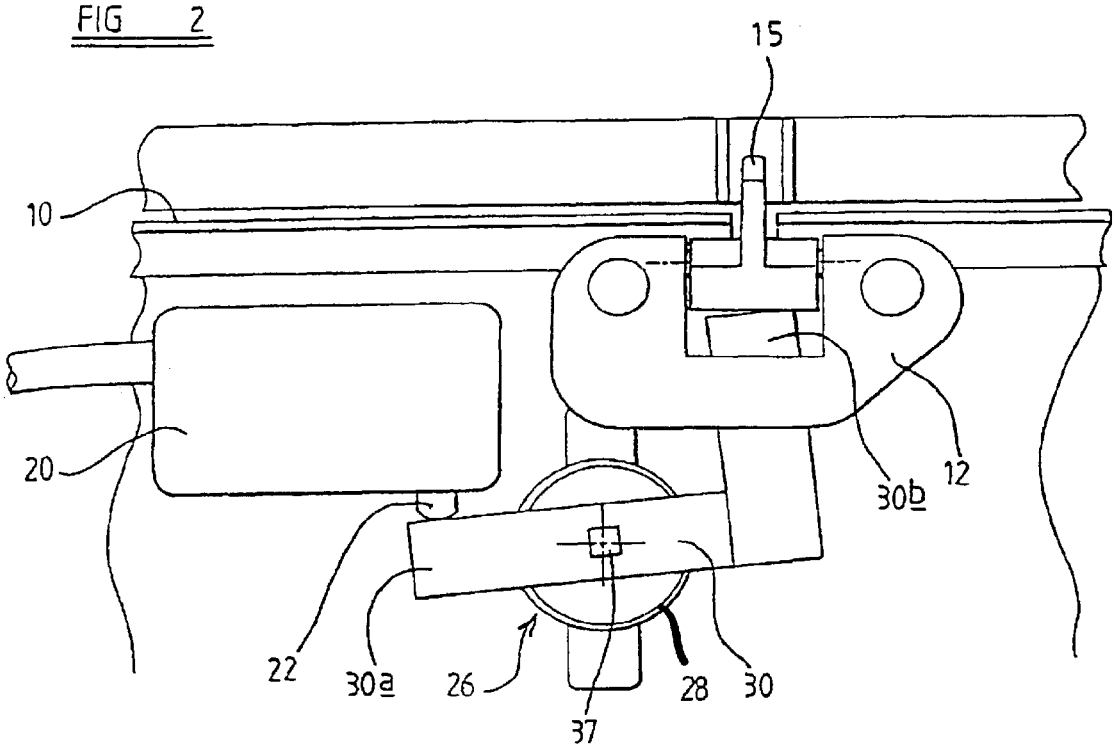
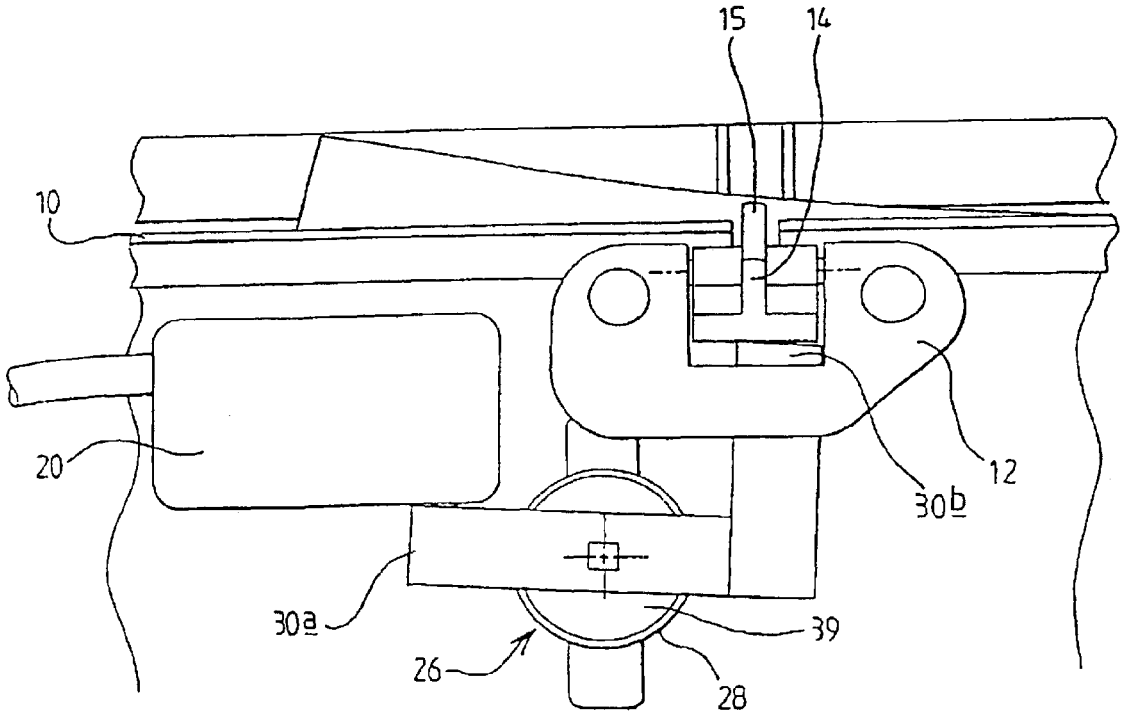
FIG 3

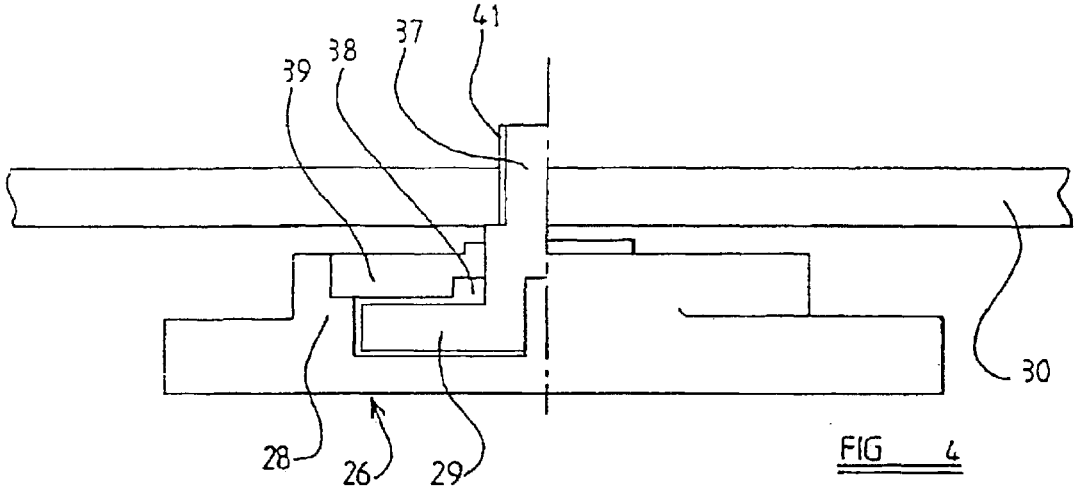
FIG 4
FIG 5
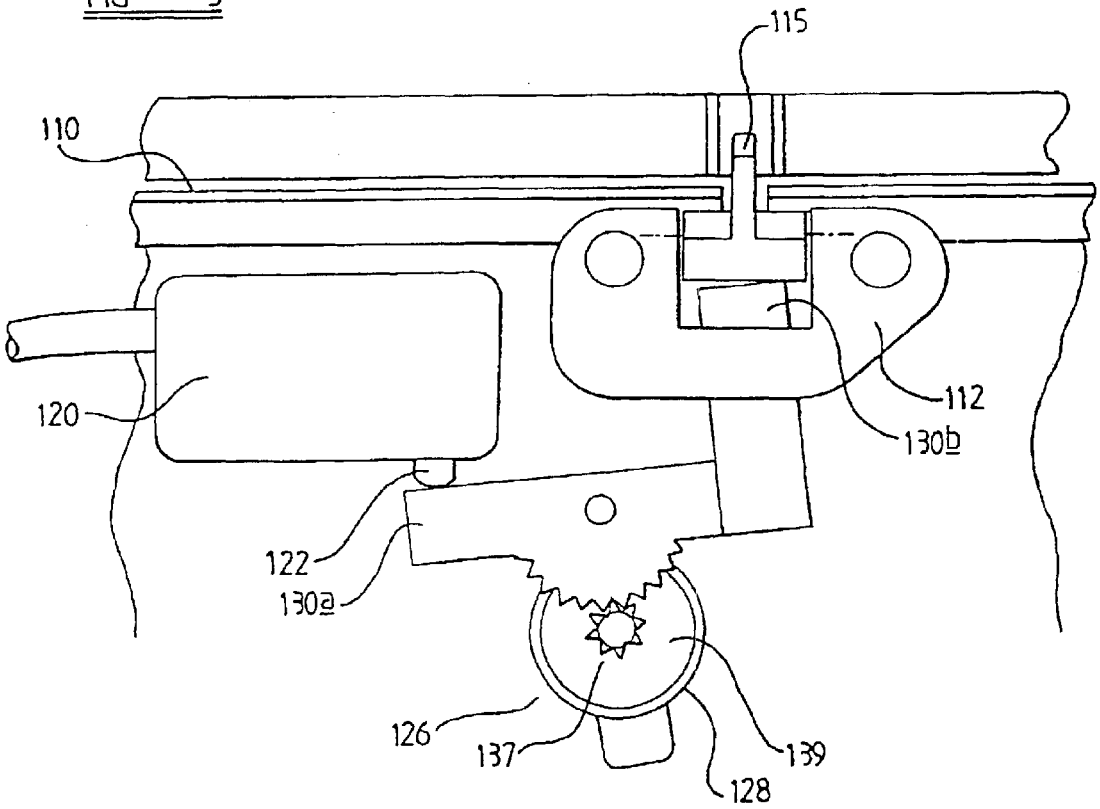

SHREDDING MACHINE, AND METHOD OF PROVIDING A TIME DELAY IN A SHREDDING MACHINE

DESCRIPTION OF INVENTION

This invention is concerned with improvements in shredding machines.

A conventional shredding machine (hereinafter referred to as being of the kind specified) comprises a housing in which a shredding mechanism is mounted, drive means being provided for the shredding mechanism. Mounted over the housing is a cover provided with a slot through which material to be shredded is fed, into engagement with shredding mechanism of the machine.

Desirably sensing means is provided in the machine, to terminate operation of the drive means when the machine is not being used, or when use has been completed. A convenient sensing means which may conveniently be incorporated into the machine comprises an optical sensor, responsive to the presence of a sheet of paper in the slot to activate, or permit activation of the drive means, and to terminate operation of the drive means when the paper has passed through the slot.

Such sensing means are expensive, and an alternative sensing means may be provided by a microswitch having an operating member which is spring-urged into an operative position in which it extends across the mouth. The operating member is thus engaged by the paper as it is inserted into the slot, to cause the microswitch to close and to cause operation of the shredding mechanism to commerce.

However, a further problem with shredding machines of the kind specified is that, to allow complete passage of material through the slot and through the shredding mechanism, it is necessary to utilise a time delay to maintain operation of the shredding mechanism for a short period of time subsequent to completion of passage of the material beyond the operating member. Conventionally such a time delay is afforded by an electronic mechanism, which adds to the cost of the machine.

According to this invention there is provided a shredding machine comprising:

a) a housing;

b) shredding mechanism in the housing;

c) a slot in the housing, through which material to be shredded enters the housing; and d) and operating member urged by resilient means into an operative position in which it extends across the mouth of the slot, to be moved to an inoperative position by entry of the material to be shredded into the housing, to cause the shredding mechanism to operate;

characterised in that there is interposed between the resilient means and the operating member a motion damping device.

Conveniently, the resilient means is provided by spring means by which the plunger of a microswitch is urged to its open condition. Thus movement of the operating member to its inoperative position causes movement of the damping device against the plunger of the microswitch, causing the microswitch to adopt its closed condition, to cause the shredding mechanism to operate. On passage of the material beyond the mouth, the operating member is released, and the damping device retards movement of the resilient means, delaying switching of the microswitch for a short period of time sufficient to allow completion of passage of material into the shredding mechanism.

According to this invention there is also provided a shredding machine comprising a) a housing;

b) shredding mechanism in the housing;

c) a drive motor in the housing to drive the shredding mechanism;

d) control means in the housing for the drive motor, said control means comprising a microswitch having a plunger spring-urged into a circuit-open condition;

e) a slot in the housing through which material to be shredded may enter the housing; and f) an operating member mounted adjacent the slot for movement between an operative position in which it extends across the mouth of the slot, and an inoperative position, movement of the operating member to its inoperative position being caused by entry of material to be shredded into the slot, the microswitch providing resilient means whereby the operating member is urged into its operative position, characterised in that there is interposed between the operating member and the resilient means a motion damping device whereby movement of the operating member under the action of the resilient means to its operative position is retarded.

Conveniently the damping device is a rotary damping device comprising a shallow cylindrical housing, and a drive member mounted in the housing with a small clearance between the interior wall of the housing and the exterior wall of the drive member, there being a viscous material, such as a viscous oil or elastomeric material, in said space to retard rotary movement of the drive member within the housing. Preferably attached to the drive member is a drive arm, extending generally diametrically of the device, one end of which engages the operating member, the other end of which engages the plunger of the microswitch.

Preferably said operating arm is L-shaped, and conveniently the operating member is freely mounted for movement relative to the housing of the machine.

According to this invention there is also provided a method of providing a time delay in a shredding machine to maintain operation of the shredding mechanism for a short period of time subsequent to completion of passage of the material through an entry slot of the machine, in which the delay is afforded by the use of a motion damping device.

There will now be given a detailed description, to be read with reference to the accompanying drawings, of a shredding mechanism which is a preferred embodiment of this invention, having been selected for the purposes of illustrating the invention by way of example.

In the accompanying drawings:

FIG. 2 is a side elevation on FIG. 1, showing an operating member projecting across the entry slot in an operative position, FIG. 3 is a view showing the plunger in an inoperative position;

FIG. 4 is a sectional view through a damping device of the machine; and

FIG. 5 is a sectional view of a modified form of the preferred embodiment.

Figure 1:
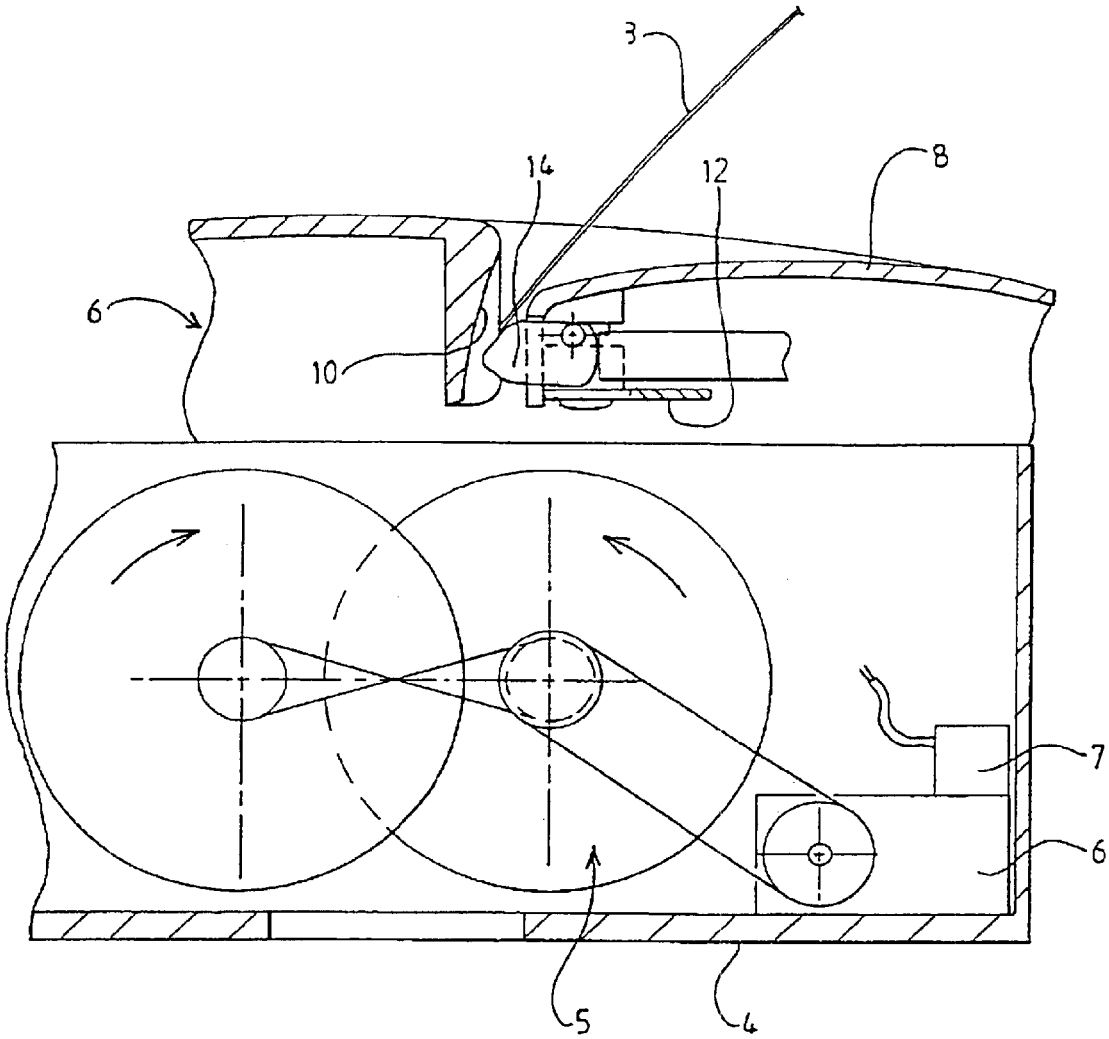
FIG. 1 is a sectional view of part of a cover of the preferred embodiment, showing the material entry slot thereof.

The shredding machine which is the preferred embodiment of this invention is a machine of the kind specified, comprising a housing 4 within which is mounted shredding mechanism 5. Mounted in the housing 4 is a drive motor 6, and a motor controller 7. The housing comprises a cover 8 within which there is provided a material entry slot 10, through which material to be shredded may be fed into the housing, to be shredded by the shredding mechanism.

Secured to the interior of the cover adjacent to the slot is a support bracket 12, which carries an operating member 14, mounted for movement therein between an operative position, in which a nose portion 15 extends across the slot (shown in FIGS. 1 and 2) and an inoperative position in which it does not. Resilient means is provided, as will be described hereinafter, to urge the operating member into its operative position.

The machine comprises a microswitch 20 comprising a plunger 22 which is spring urged into a projecting position (shown in FIG. 2), in which it is open circuit, and in which the shredding mechanism does not operate.

Also mounted on the underside of the cover 8 is a rotary damping device 26, comprising a cylindrical housing 28 providing a damping chamber 38, closed by a cover 39, within which chamber drive member 29 is mounted for rotary movement. Within the space between the exterior surfaces of the drive member 29 and the interior surfaces of the housing 28, a viscous fluid is provided, conveniently a viscous oil or a gel, to retard movement of the drive member 29 in the cylinder 28. The drive member is secured by an axial shaft 37, passing through the cover 39, to a drive arm 30, in the preferred embodiment of L-shape, one end portion 30*a* of which is located adjacent to the plunger 22 of the microswitch, the opposite end portion 30*b* of which is in engagement with the operating member 14.

At rest, the spring means of the microswitch urges the plunger into its projecting position, causing the operating arm 30 to act on the operating member 14 to cause it to adopt its operative position, in which it projects across the slot 10.

When a sheet 3 of documentary material is entered into the slot, as is shown in FIG. 1, the material presses the nose portion 15 of the operating member 14 rearwardly, causing the drive arm 30 to rotate in a clockwise direction from the position shown in FIG. 2 to the position shown in FIG. 3, depressing the plunger 22 of the microswitch, closing an electric circuit and causing the shredding mechanism to operate, to draw the sheet material through the slot. On completion of passage of the sheet through the slot, the operating member 14 is again allowed to move from its inoperative position shown in FIG. 3 to its operative position shown in FIG. 2, under the force of the resilient means of the microswitch. However the rotary damping device retards movement of the plunger 22, and a short delay occurs before the microswitch adopts its off condition, causing operation of the shredding mechanism to be maintained for a short period of time—typically 1–2 seconds, after passage of the sheet beyond the nose 15. Such movement it will be appreciated simultaneously causes the nose portion 15 of the operating member 14 to move into the slot.

In the modified form of the preferred embodiment shown in FIG. 5, in which similar numerals increased by 100 have been utilised to indicate parts similar in construction and operation to those of the preferred embodiment, the rotary damping device 126 is offset from the axis of rotation of the drive arm 130. The cylindrical drive member 129 is provided at its axis of rotation with a ring gear 88, engageable with gearing 98 provided on the drive arm 130, and extending partly around the axis of rotation of the drive arm 130.

In this way, a small movement of the drive arm, as produced in the operation of the machine, produces an increased rotation of the drive member 129, and thus increases the sensitivity of the arrangement.

It will be appreciated that the period of delay will be relatively short, and may to some extent be determined by the geometry of the arrangement, in particular the distance between the plunger 22 of the microswitch and the longitudinal axis of the damping device, whereby the mechanical advantage may be changed. Alternatively or in addition, the period may be varied by changing the viscosity of the viscous material in the damping chamber.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A shredding machine, comprising:

a) a housing;

b) a shredding mechanism in the housing;

c) a slot in the housing through which a material to be shredded enters the housing;

d) an operating member urged by a resilient means into an operative position in which the operating member extends across a mouth of the slot, to be moved to an inoperative position by entry of the material to be shredded into the housing, to cause the shredding mechanism to operate; and e) a motion damping device interposed between the resilient means and the operating member.

2. The shredding machine according to claim 1, wherein the resilient means comprises a spring means by which a plunger of a microswitch is urged to an open condition.

3. The shredding machine according to claim 1, wherein the motion damping device includes a drive member and a viscous material for retarding movement of the drive member.

4. The shredding machine according to claim 3, wherein the operating member is operative to move the drive member in a cylindrical chamber.

5. The shredding machine according to claim 4, wherein the cylindrical chamber is shallow, and wherein the drive member is mounted in the cylindrical chamber with a small clearance between an interior wall of the cylindrical chamber and an exterior wall of the drive member, and wherein the viscous material is provided in said clearance.

6. The shredding machine according to claim 3, wherein the motion damping device includes a drive arm connected to the drive member, the drive member having one end which engages the operating member, and another end which engages a plunger of a microswitch.

7. The shredding machine according to claim 6, wherein the drive arm is L-shaped.

8. The shredding machine according to claim 1, wherein the motion damping device includes a cylindrical chamber, a drive member mounted for rotary movement in the chamber, and frictional resistance means in the chamber for retarding the movement of the drive member, said drive member carrying a drive arm having one end which engages the operating member,and another end which engages a plunger of a microswitch.

9. A shredding machine, comprising:

a) a housing;

b) a shredding mechanism in the housing;

c) a drive motor in the housing for driving the shredding mechanism;

d) a control means in the housing for the drive motor, said control means including a microswitch having a plunger spring-urged into a circuit-open condition;

e) a slot in the housing through which a material to be shredded enters the housing;

f) an operating member mounted adjacent the slot for movement between an operative position in which the operating member extends across a mouth of the slot, and an inoperative position, the movement of the operating member to its inoperative position being caused by entry of the material to be shredded into the slot, the microswitch providing a resilient means for urging the operating member into said operative position; and g) a motion damping device interposed between the operating member and the resilient means, for retarding the movement of the operating member under the action of the resilient means to said operative position.

* * * * *